US011370575B2

(12) United States Patent
Wen et al.

(10) Patent No.: US 11,370,575 B2
(45) Date of Patent: Jun. 28, 2022

(54) ROBOTIC LABELING SYSTEM AND METHOD OF LABELING PACKAGES

(71) Applicant: TE Connectivity Services GmbH, Schaffhausen (CH)

(72) Inventors: Du Wen, Reading, PA (US); Kevin Eshleman, Manheim, PA (US); Swapnilsinh Solanki, Harrisburg, PA (US); Jiankun Zhou, Mechanicsburg, PA (US); Roberto Francisco-Yi Lu, Bellevue, WA (US)

(73) Assignee: TE CONNECTIVITY SERVICES GMBH

( * ) Notice: Subject to any disclaimer, the term of this patent is extended or adjusted under 35 U.S.C. 154(b) by 0 days.

(21) Appl. No.: 17/037,971

(22) Filed: Sep. 30, 2020

(65) Prior Publication Data

US 2022/0097892 A1 Mar. 31, 2022

(51) Int. Cl.

| | |
|---|---|
| ***B65C 9/44*** | (2006.01) |
| ***B65C 9/26*** | (2006.01) |
| ***B65C 9/40*** | (2006.01) |

(52) U.S. Cl.

CPC ..... *B65C 9/44* (2013.01); *B65C 9/26* (2013.01); *B65C 2009/401* (2013.01); *B65C 2009/407* (2013.01); *B65C 2009/408* (2013.01)

(58) Field of Classification Search

CPC .. B29C 1/021; B29C 9/02; B29C 9/04; B29C 9/06; B29C 9/26; B29C 9/40; B29C 9/44; B29C 9/46; B29C 2009/401; B29C 2009/407; B29C 2009/408

See application file for complete search history.

(56) References Cited

U.S. PATENT DOCUMENTS

| | | | | |
|---|---|---|---|---|
| 2013/0174960 | A1* | 7/2013 | Goetz | B65C 3/00 156/64 |
| 2014/0096900 | A1* | 4/2014 | Wojdyla | B65C 9/02 156/247 |
| 2014/0104626 | A1* | 4/2014 | Giordano | G09F 3/0288 358/1.6 |
| 2016/0052659 | A1* | 2/2016 | Bowers | B65C 1/021 156/64 |
| 2016/0063770 | A1* | 3/2016 | Bowers | B07C 3/14 156/64 |
| 2018/0221244 | A1* | 8/2018 | Joplin | B65B 61/20 |
| 2018/0265239 | A1* | 9/2018 | Riva | B65C 1/021 |

* cited by examiner

*Primary Examiner* — George R Koch

(57) ABSTRACT

A robotic labeling system for packages includes a package database management system including a package database storing package data and a package labeling controller communicatively coupled to the package database management system. The robotic labeling system includes a package locating system receiving locating inputs from the package labeling controller for locating the packages at a labeling station and a package identification system having a scanning device scanning an identification tag on the package to determine the package identification and orientation. The robotic labeling system includes a label application system having a labeling device and label applicator that prepares and applies a shipping label and a customer specific label to the package based on the content data stored in the package database. The robotic labeling system may verify the applied labels based on the scanned data on the package and either discharging or rejecting the package based on the scanned data.

20 Claims, 4 Drawing Sheets

ROBOTIC LABELING SYSTEM AND METHOD OF LABELING PACKAGES

BACKGROUND OF THE INVENTION

The subject matter herein relates generally to package labeling systems and methods.

Package labeling is a manual process at many warehouses and distribution centers. The manual labeling process relies on operators to determine the location where the labels need to be applied. Manual labeling processes have high labor costs, are subject to human error, and are time consuming to apply the labels. Additionally, labels applied manually to packages may be at improper or unwanted positions and may be applied inconsistently from package to package. Some known automated labeling systems are in use in warehouses and distribution centers. However, conventional labeling systems use simple labeling methods to apply the labels to the packages. For example, the conventional labeling systems use a single axis arm attached to a printer to apply the label to the box. The label is always applied to the same side of the box. The box is required to have a particular orientation relative to the printer and the label applicator. Known automated labeling systems do not tend to accommodate different sized packages.

A need remains for a dynamic, automated labeling system for labeling packages.

BRIEF DESCRIPTION OF THE INVENTION

In one embodiment, a robotic labeling system for packages is provided. The robotic labeling system includes a package database management system including a package database. The package database stores package identification data specific to each of the packages. The package database stores shipping data specific to each of the packages. The package database stores content data specific to each of the packages. The robotic labeling system includes a package labeling controller communicatively coupled to the package database management system. The robotic labeling system includes a package locating system operably coupled to the package labeling controller to receive locating inputs from the package labeling controller for locating the packages at a labeling station. The robotic labeling system includes a package identification system operably coupled to the package labeling controller. The package identification system has a scanning device configured to scan an identification tag on the package to determine a package identification of the package and an orientation of the package in the labeling station. The package identification system sends a package identification signal to the package labeling controller based on the scan. The package identification system sends a package orientation signal to the package labeling controller based on the scan. The robotic labeling system includes a label application system operably coupled to the package labeling controller. The label application system includes at least one labeling device and at least one label applicator. The at least one labeling device prepares a shipping label for the package based on the shipping data stored in the package database. The at least one label applicator is operated to apply a customer specific label to the package based on the content data stored in the package database.

In another embodiment, a method of labeling packages is provided. The method stores package identification data specific to each of the packages, ships data specific to each of the packages, and provides content data specific to each of the packages in a package database of a package database management system. The method communicatively couples a package labeling controller to the package database management system. The method locates the package in a labeling station and scans an identification tag on the package using a scanning device to determine a package identification of the package and an orientation of the package in the labeling station. The method sends a package identification signal and a package orientation signal to the package labeling controller based on the scan. The method retrieves the shipping data and the content data specific to the package from the package database based on the package identification signal and prepares a shipping label for the package based on the shipping data from the package database and a customer specific label for the package based on the content data from the package database. The method applies the shipping label and the customer specific label to the package and scans the shipping label and the customer specific label applied to the package using a label verification scanning device to verify proper application of the shipping label and the customer specific label.

DETAILED DESCRIPTION OF THE INVENTION

Figure 1:
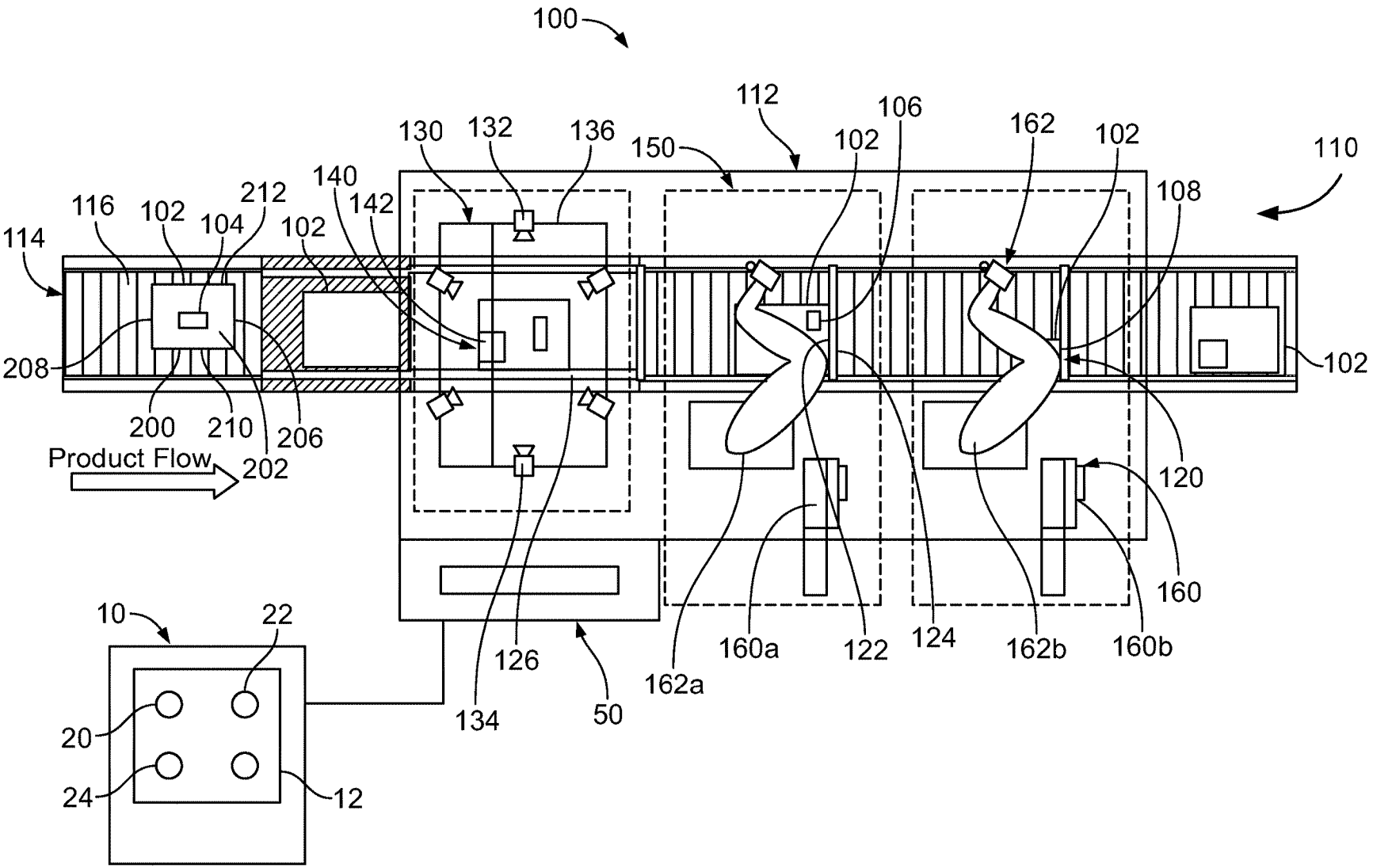
FIG. 1 illustrates a robotic labeling system in accordance with an exemplary embodiment.

FIG. 1 illustrates a robotic labeling system 100 in accordance with an exemplary embodiment. The robotic labeling system 100 is an automated system used for labeling packages 102. The robotic labeling system 100 is integrated with a package database management system 10, such as a warehouse management system (WMS). The package database management system 10 includes a package database 12 storing data related to the packages 102, such as for storing the packages 102, moving the packages 102 within the warehouse, processing the packages 102, labeling the packages 102, shipping the packages 102, and the like. The robotic labeling system 100 includes a package labeling controller 50 controlling operation of components of the robotic labeling system 100. The package labeling controller 50 is communicatively coupled to the package database management system 10 to send and receive data and/or control signals for controlling operation of the robotic labeling system 100. The robotic labeling system 100 is operated based on data from the package database management system 10. In an exemplary embodiment, the robotic labeling system 100 utilizes one or more robots for applying one or more labels on the packages 102. The robotic labeling system 100 uses intelligent control algorithms to apply the label(s). The robotic labeling system 100 scans the labels after application to verify proper application of the label(s) to the package 102 before sending the package to another processing station.

The package database management system 10 may be housed on a computer or computer network remote from the robotic labeling system 100. The package labeling controller 50 may be housed on a computer associated with the robotic labeling system 100. Alternatively, the package labeling controller 50 may be located remote from the robotic labeling system 100, such as at the computer or network housing the package database management system 10. The package labeling controller 50 includes hardware and/or software for controlling operation of the robotic labeling system 100.

The robotic labeling system 100 includes a package locating system 110 for locating the package 102 in a labeling station 112. The robotic labeling system 100 includes a package identification system 130 for identifying the package 102 in the labeling station 112. The robotic labeling system 100 includes a label application system 150 for applying labels to the package 102. In various embodiments, the label application system 150 may apply multiple labels to each package 102, such as to various sides 200 of the package 102. Optionally, multiple labeling stations may be provided and the package locating system 110 is used to locate packages at the various labeling stations. The package labeling controller 50 is communicatively coupled to the package locating system 110, the package identification system 130, and the label application system 150. The package labeling controller 50 receives inputs from the package locating system 110 and/or the package identification system 130 and/or the label application system 150. The package labeling controller 50 controls operations of the package locating system 110 and/or the package identification system 130 and/or the label application system 150.

The package 102 may be a box, such as a cardboard box, or other type of container. In various embodiments, the package 102 may be parallelepiped having six sides 200, including a top side 202, a bottom side (not shown, but located opposite the top side 202), a front side 206, a rear side 208, a right side 210, and a left side 212. The package 102 may include additional sides 200 in alternative embodiments. The package 102 may have other shapes in alternative embodiments. In various embodiments, the sides 200 may be flat or planar. Alternatively, one or more of the sides 200 may be curved. In an exemplary embodiment, the sides 200 meet at corners and have edges extending between the corners. In various embodiments, one or more the sides 200 may be defined by panels meeting at seams. The panels may be taped at the seams. In various embodiments, the label application system 150 may avoid applying the labels at the seams (for example, avoid applying the labels over the tape).

In an exemplary embodiment, the package 102 includes an identification tag 104 at one of the sides 200. For example, the identification tag 104 may be a label applied to one of the sides 200. Alternatively, the identification tag 104 may be printed or otherwise placed directly on one of the sides 200. The identification tag 104 is used to identify the particular package 102 (for example, compared to other packages 102). The identification tag 104 may be a unique identifier for the package 102. Information about the package 102 may be associated with the identification tag 104, such as data contained in the package database 12 of the package database management system 10. The identifying data about the package 102 may include content data 20 relating to the contents of the package. The identifying data about the package 102 may include dimensional data 22 relating to the height, width and length of the package. The identifying data may include shipping data 24 relating to the package 102.

In various embodiments, the identification tag 104 is a scannable tag, such as a barcode, a data matrix, a QR code, or another type of symbolic scan code. The identification tag 104 may be used to track the package 102 within a warehouse, such as movement of the package 102 between various processing stations. In various embodiments, the identification tag 104 is applied to the package 102 outside of the labeling station 112. For example, the identification tag 104 may be applied to the package 102 prior to the package 102 being transported to the labeling station 112. The identification tag 104 may be applied to the package 102 when the package 102 is formed or when the package 102 is filled, such as at a packing station upstream of the labeling station 112. Alternatively, the identification tag 104 may be applied by the label application system 150 at the labeling station 112. The identification tag 104 may be applied to any of the sides 200. In various embodiments, the identification tag 104 may be on any of the sides 200 other than the bottom side 204. In various embodiments, multiple identification tags 104 may be provided, such as on two opposite sides (for example, to avoid having the identification tag 104 on the bottom side 204, and thus unviewable, as the package 102 is presented to the labeling station 112).

In an exemplary embodiment, the package 102 receives a shipping label 106. The shipping label 106 contains information about where the package 102 is being shipped. The shipping label 106 may include a name, an address, or other identifying data. In various embodiments, the shipping label 106 may include symbolic scan codes used for shipping. The shipping label 106 is applied to the package 102 by the label application system 150 at the labeling station 112. The shipping label 106 may be applied to any of the sides 200 other than the bottom side 204. In an exemplary embodiment, the shipping label 106 is applied to any of the sides 200 that does not include the identification tag 104. In various embodiments, the label application system 150 does not apply any other labels to the side 200 that receives the shipping label 106.

In an exemplary embodiment, the package 102 receives one or more customer specified labels 108. The customer specified label 108 or CSL 108 may contain information about the contents of the package 102 or other information. For example, the customer specified label 108 may contain information about the shipper of the package 102, the location of where the package 102 is being shipped from, return shipping information, warning labels regarding the package 102 or the content of the package 102, and the like. In various embodiments, the customer specified label 108 may include symbolic scan codes having data relating to the content of the package 102 or other information. The customer specified label 108 is applied to the package 102 by the label application system 150 at the labeling station 112. The customer specified label 108 may be applied to any of the sides 200 other than the bottom side 204. The customer specified label 108 may be applied to any of the sides 200 that do not include the identification tag 104. In various embodiments, the label application system 150 does not apply any other labels to the side 200 that receives the customer specified label 108. For example, the shipping label 106 is applied to a different side 200 than the customer specified label 108. Other types of labels may be applied to the package 102 in alternative embodiments.

In an exemplary embodiment, the package locating system 110 includes a transportation device 114 for moving the package 102 to the labeling station 112. In the illustrated embodiment, the transportation device 114 includes a conveyor 116. The conveyor 116 is operably coupled to the package labeling controller 50 and controlled by the package labeling controller 50. The conveyor 116 moves the package to the package identification system 130 and/or moves the package 102 to the label application system 150 and/or moves the package 102 away from the labeling station 112, such as to a sorting station or other processing station such as a robotic palletizer. The conveyor 116 may move the package to a discard or reject area if the package 102 is not labeled or incorrectly labeled. Other types of transportation devices 114 may be used in alternative embodiments.

The package locating system 110 includes one or more indexing devices 120 having datum surfaces 122 for locating the package 102 in the labeling station 112. In the illustrated embodiment, multiple indexing devices 120 are provided for positioning the packages 102 at different positions within the labeling station 112. The indexing device 120 may include a stop gate 124 used to stop the package 102 on the conveyor 116. The stop gate 124 controls a front-to-rear position of the package 102 in the labeling station 112. The indexing device 120 may include a side rail 126 for controlling a side-to-side position of the package 102 in the labeling station 112. In various embodiments, the stop gate 124 and the side rail 126 may position the package 102 at a datum position for measuring the package. In various embodiments, the stop gate 124 and the side rail 126 may position the package 102 at a datum position for scanning the package, such as for identifying the package 102, such as for scanning the identification tag 104. In various embodiments, the stop gate 124 and the side rail 126 may position the package 102 at a datum position for applying the label(s) to the package 102. When the package 102 engages the stop gate 124 and the side rail 126, the location of the package 102 is known by the robotic labeling system 100 for applying the labels to the package 102. Other types of indexing devices may be used in alternative embodiments.

In an exemplary embodiment, the package identification system 130 includes a scanning device 132 for identifying the package 102. The scanning device 132 is operably coupled to the package labeling controller 50 and may be controlled by the package labeling controller 50. Signals or data from the scanning device 132 may be transmitted to the package labeling controller 50 to control other operations of the robotic labeling system 100. In various embodiments, the scanning device 132 may include one or more cameras 134. The cameras 134 may be mounted to a frame 136. The frame 136 may be movable to control positioning of the camera(s) 134. In an exemplary embodiment, the cameras 134 are configured to view multiple sides 200 of the package 102. The scanning device 132 allows for vision inspection of the package 102. For example, the package labeling controller 50 may perform vision inspection, such as to identify the package 102, identify the identification tag 104 on the package, and the like.

In an exemplary embodiment, the scanning device 132 identifies an orientation of the package 102 in the labeling station 112. The label application system 150 is controlled based on the orientation of the package 102. The orientation of the package 102 in the labeling station 112 may be based on the location of the identification tag 104 (for example, the side 200 having the identification tag 104). For example, the scanning device 132 scans the package 102 to identify the particular side 200 having the identification tag 104. For example, the scanning device 132 may identify the top side 202 as having the identification tag 104 (top-side orientation); may identify the front side 206 is having the identification tag 104 (front-side orientation); may identify the rear side 208 as having the identification tag 104 (rear-side orientation); may identify the right side 210 as having the identification tag 104 (right-side orientation); or may identify the left side 212 as having the identification tag 104 (left-side orientation). The operation of the label application system 150 is controlled based on which side 200 has the identification tag 104. For example, the label application system 150 may determine appropriate sides 200 to apply the shipping label 106 and the customer specified label 108 based upon which side 200 has the identification tag 104.

In an exemplary embodiment, the package identification system 130 identifies a size of the package 102 and a shape of the package 102. In various embodiments, the scanning device 132 may be used to identify the size and the shape of the package 102. For example, the scanning device 132 may be used to scan the identification tag 104 and determine the size and shape of the package 102 based on data from the identification tag 104 (for example, data in the package database 12). For example, when the identification tag 104 is scanned, the package labeling controller 50 communicates with the package database 12 to receive the dimensional data 22 of the package 102 stored in the package database 12. In other various embodiments, the cameras 134 may be used to image the package 102 and the package labeling controller 50 may determine the size and the shape of the package 102 based on the image. For example, the package labeling controller 50 may identify the number of sides 200, the number of corners, the number of edges, the number of seams, the location of the seams, and the like based on pattern or boundary recognition. The package labeling controller 50 may identify a height of the package 102 and/or a width of the package 102 and/or a length of the package 102 from analysis of the image.

In various embodiments, the package labeling controller 50 includes a package measurement module 140 configured to determine at least one dimension of the package 102. The package measurement module 140 may include software to analyze the image data to determine the height and/or the width and/or the length of the package 102. The package identification system 130 may include one or more sensors 142, such as proximity sensors, distance measuring sensors, and the like for measuring one or more dimensions of the package 102. The sensors 142 transmit data or signals to the package measurement module 140 to determine dimensions of the package 102 with reference to the datum of the indexing device 120.

In an exemplary embodiment, the size dimensions of the package 102 are used by the package labeling controller 50 to control the label application system 150. For example, the package labeling controller 50 may use the size dimensions to determine relevant labeling locations on the package 102. The package labeling controller 50 may control the labeling robots to apply the labels to the package 102. In an exemplary embodiment, the robotic labeling system 100 is capable of receiving different sized and shaped packages 102 and is capable of labeling such packages 102 by automatically determining the size and shape of the particular package 102 at the labeling station 112.

The label application system 150 is used to apply the labels to one or more of the sides 200 of the package 102. The package labeling controller 50 controls operation of the label application system 150. In an exemplary embodiment, the label application system 150 includes one or more labeling devices 160 configured to transfer labeling information to the package 102. In various embodiments, the labeling devices 160 may be label printers configured to print corresponding labels for the package 102. In other various embodiments, the labeling devices may imprint labeling information directly on the package 102. The label application system 150 includes one or more label applicators 162 configured to apply the labeling information on the package 102, such as transferring the labels from the labeling device 160 to the package 102. The label applicators 162 are used to apply the labels (or labeling information) to the package 102. For example, the label applicators 162 may press the labels onto the sides 200 of the packages 102. In the illustrated embodiment, the label application system 150 includes a pair of the labeling devices 160 and a pair of the label applicators 162 for applying the labels; however, the label application system 150 may include greater or fewer labeling devices 160 and label applicators 162.

In an exemplary embodiment, the package labeling controller 50 is operably coupled to the labeling device 160 and the label applicator 162. The package labeling controller 50 receives inputs from the package locating system 110 and the package identification system 130 to determine a labeling scheme for labeling the package 102. The package labeling controller 50 determines which label to print, such as the shipping label 106, the customer specified label 108 or another type of label. The package labeling controller 50 controls operation of the labeling device 160. The package labeling controller 50 controls the labeling information, such as the information printed on the label. The package labeling controller 50 controls operation of the label applicator 162 based on the orientation of the package 102. For example, the package labeling controller 50 controls which side 200 the label applicator 162 applies the label to based on the side 200 having the identification tag 104. The package labeling controller 50 controls operation of the label applicator 162 based on the size and shape of the package 102 determined by the package identification system 130. For example, the package labeling controller 50 determines appropriate labeling locations relative to the datum surface 122, based on the size and shape of the package 102, and controls movements of the label applicator 162 to move to such labeling locations.

Figure 2:
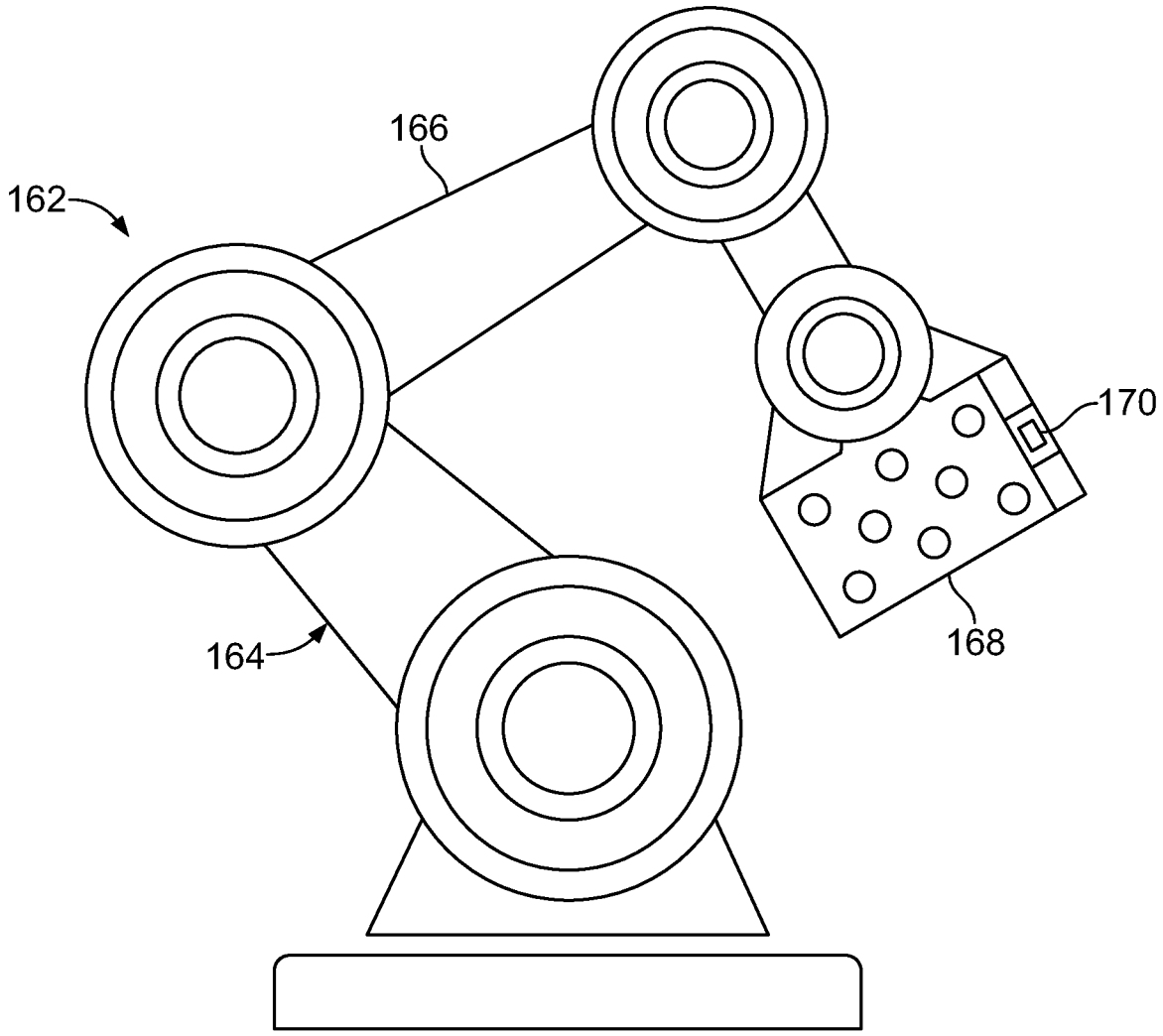
FIG. 2 illustrates the label applicator in accordance with an exemplary embodiment.

With reference to FIG. 2, which illustrates the label applicator 162 in accordance with an exemplary embodiment, the label applicator 162 includes a multi-axis robot 164 having an articulating arm 166 that moves between the labeling device 160 and the package 102. An end effector 168 is provided at the end of the arm 166 to pick up the label from the labeling device 160 and to apply the label to the side 200 of the package 102. In various embodiments, the end effector 168 may be a vacuum end effector using suction to hold the label on the end effector 168. Other types of end effectors may be used in alternative embodiments. The arm 166 is movable in three-dimensional space to apply labels to the top side 202 and/or the front side 206 and/or the rear side 208 and/or the right side 210 and/or the left side 212 of the package 102. The label applicator 162 is capable of applying multiple different labels on different sides of the package. The label applicator 162 is capable of applying labels to different sized boxes.

In an exemplary embodiment, the label application system 150 includes a label verification scanning device 170 configured to scan the labels applied to the package 102 to verify proper application of the labels. The label verification scanning device 170 allows for vision inspection and verification of the labels. For example, the label verification scanning device 170 may verify that the label has been applied. The label verification scanning device 170 may verify that the label is on the proper side 200 of the package 102. The label verification scanning device 170 may verify that the label is in the proper location on the package 102. The label verification scanning device 170 may verify that the label has the appropriate information on the label. The label verification scanning device 170 may verify that the labeling information is legible and/or scannable. The label verification scanning device 170 may verify that the label is applied correctly and without wrinkles. If the label verification scanning device 170 determines the applied label is defective, the package 102 may be rejected. However, if the label verification scanning device 170 verifies that the label is properly applied to the package 102, the package 102 may be transferred downstream to the next processing station, such as a package sorting station. In various embodiments, the label verification scanning device 170 may be coupled to the arm 166 and movable with the arm 166. As such, the label verification scanning device 170 is movable to view various sides of the package 102. Alternatively, the label verification scanning device 170 may be separate from the arm, such as including cameras mounted around the labeling station 112 to view the different sides of the package 102. The label verification scanning device 170 may scan the label immediately after the label is applied, such as prior to the arm 166 moving away from the application area. The label verification scanning device 170 may include a camera configured to image the label.

Figure 3:
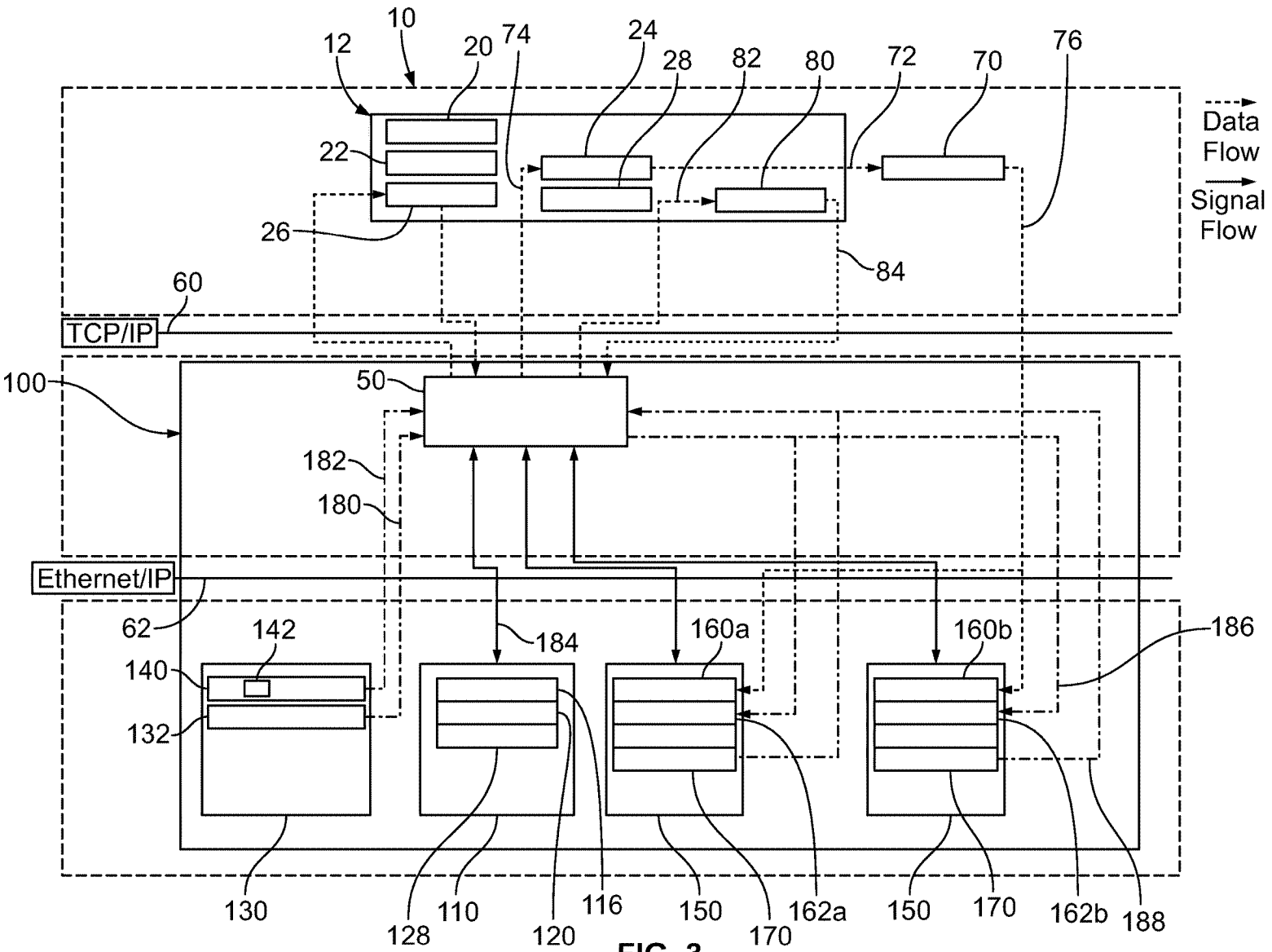
FIG. 3 is a system diagram of the robotic labeling system in accordance with an exemplary embodiment.

FIG. 3 is a system diagram of the robotic labeling system 100 in accordance with an exemplary embodiment. The robotic labeling system 100 is communicatively coupled with the package database management system 10. The robotic labeling system 100 communicates with the package database management system 10 through a first communication bus 60, such as a TCP/IP data bus. For example, the package database management system 10 may communicate with the package labeling controller 50 through the first communication bus 60. The components of the robotic labeling system 100 communicate with each other through a second communication bus 62, such as an ethernet/IP data bus. For example, the package locating system 110, the package identification system 130 and the label application system 150 may communicate with the package labeling controller 50 through the second communication bus 62.

The package database management system 10 includes the package database 12. The package database 12 includes a package list 26 of the packages 102. The package list 26 may include license tags associated with each of the packages 102. The package database 12 includes the content data 20 relating to the contents of the package. For example, the content data may list the contents contained within the package 102. The package database 12 includes the dimensional data 22 of the package 102 (for example, height data, width data and length data). The package database 12 includes the shipping data 24 relating to the package 102, such as the shipping address. The package database 12 includes label data 28 relative to the labels. For example, the label data 28 may relate to the type of labels, the quantity of labels, the label orientation, and the like. In various embodiments, the robotic labeling system 100 may be used to place the shipping label 106 and one of the customer specific labels 108; however, the robotic labeling system 100 may place additional labels in alternative embodiments.

In an exemplary embodiment, the package database management system 10 includes a print queue module 70. Alternatively, the print queue module 70 may be part of the package labeling controller 50. The print queue module 70 receives print information 72 from the package database 12. For example, the print queue module 70 receives the label data 28 and the shipping data 24. The print queue module 70 receives a trigger signal 74 from the package labeling controller 50, such as when the package is properly located in the labeling station. The print queue module 70 sends print data 76 to the label application system 150 upon receiving the trigger signal 74.

In an exemplary embodiment, the package database management system 10 includes a label verification module 80. The label verification module 80 receives verification information 82 from the package labeling controller 50. For example, verification information 82 is transmitted after the label verification scanning device 170 scans the applied labels on the package 102. The label verification module 80 verifies that the label is applied correctly or determines if the label is applied incorrectly. The label verification module 80 then transmits a verification signal 84 to the package labeling controller 50. The verification signal 84 may be a pass signal or a fail signal. Other verification signals may be transmitted in alternative embodiments, such as a re-scan signal or a re-application signal. The package labeling controller 50 controls operation of the robotic labeling system 100 based on the verification signal 84. For example, the package locating system 110 may cause the package 102 to be moved based on the verification signal 84, such as to another processing station or to a reject station. The package labeling controller 50 may cause the label applicator 162 to reapply the label when the re-application signal is received or may cause the label applicator 162 to rescan the label when the re-scan signal is received.

The robotic labeling system 100 includes the package labeling controller 50, the package locating system 110, the package identification system 130 and the label application system 150. The package labeling controller 50 communicates with the package database management system 10 to control the package locating system 110, the package identification system 130 and the label application system 150. For example, data or signals from the package database management system 10 are used at the package labeling controller 50 to control the operations of the robotic labeling system 100. The package database management system 10 may be housed on a computer or computer network remote from the robotic labeling system 100.

In the illustrated embodiment, the label application system 150 includes a first labeling device 160*a* and associated first label applicator 162*a* and includes a second label applicator 162*b* and associated second label applicator 162*b*. The package locating system 110 is communicatively coupled to the package labeling controller 50. The package identification system 130 is communicatively coupled to the package labeling controller 50. The label application system 150 is communicatively coupled to the package labeling controller 50. For example, the first and second labeling devices 160*a*, 160*b* are communicatively coupled to the package labeling controller 50 and the first and second label applicators 162*a*, 162*b* are communicatively coupled to the package labeling controller 50. In an exemplary embodiment, the package locating system 110, the package identification system 130 and the label application system 150 communicate with the package labeling controller 50 through the second communication bus 62.

The package identification system 130 includes the scanning device 132 and the package measurement module 140. The scanning device 132 scans the package 102, such as to identify the package 102. For example, the scanning device 132 may scan the identification tag 104 of the package 102 to identify the particular package 102. The identification tag 104 may be a barcode and the scanning device 132 may be a barcode reader. In various embodiments, the scanning device 132 may image the package 102. Scan data 180 is communicated from the package identification system 130 to the package labeling controller 50, such as through the second communication bus 62. The scan data 180 is used to identify the package 102 that is moved through the labeling station 112, such as with reference to the package database 12. The package is scanned to identify the package to control other operations, such as printing appropriate labels, for proper label application, and the like. In various embodiments, the scan data 180 may be used to identify the orientation of the package 102 in the labeling station 112. For example, the scan data 180 may identify the side of the package 102 that has the identification tag 104, which allows the robotic labeling system 100 to determine the orientation of the package 102. The package labeling controller 50 uses the orientation information to control the label applicator 162 for applying additional labels (for example, the shipping label 106 and the customer specific label 108 to other sides of the package 102).

The package measurement module 140 measures the dimensions of the package 102, such as using the sensor 142. Measurement data 182 is communicated from the package identification system 130 to the package labeling controller 50, such as through the second communication bus 62. The measurement data 182 may be used for proper positioning of the package 102 in the labeling station 112 using the indexing device. The measurement data 182 may be used for proper positioning of the labels by the label applicator 162. In various embodiments, the dimensions of the package 102 may be determined by the robotic labeling system 100 using the dimensional data stored in the package database 12 rather than using the sensors 142 to measure the package 102.

The package locating system 110 includes the conveyor 116 for moving the packages 102 within the robotic labeling system 100 and the indexing device 120 including the stop gate 124 for positioning the packages 102 in the labeling station 112. In an exemplary embodiment, the package locating system 110 includes sensors 128 for detecting presence of the package 102 and/or location of the package 102 in the labeling station 112. Signals relating to the presence/location from the sensors 128 are communicated to the package labeling controller 50, such as to control operation of the conveyor 116 and/or the stop gate 124. The sensor signals are communicated through the second communication bus 62. Locating control signals 184 are transmitted from the package labeling controller 50 to the package locating system 110. The locating control signals 184 are used to control operation of the conveyor 116 and/or the stop gate 124. The locating control signals 184 are communicated through the second communication bus 62.

The label application system 150 includes the first labeling device 160*a* and associated first label applicator 162*a* and the second label applicator 162*b* and associated second label applicator 162*b*. In the illustrated embodiment, the first and second labeling devices 160*a*, 160*b* are communicatively coupled to the print queue module 70. The first and second labeling devices 160*a*, 160*b* receive the print data 76 from the print queue module 70. However, in alternative embodiments, the robotic labeling system 100 may be provided without the print queue module 70. Rather, the print data 76 may be transmitted from the package labeling controller 50. In other alternative embodiments, the print queue module 70 may be a component of the package labeling controller 50 to transmit the print data 76 from the package labeling controller 50.

In an exemplary embodiment, the first and second label applicators 162*a*, 162*b* are communicatively coupled to the package labeling controller 50 through the second communication bus 62. The first and second label applicators 162*a*, 162*b* receive applicator control signals 186 from the package labeling controller 50. The applicator control signals 186 control operation of the first and second label applicators 162*a*, 162*b*. For example, the applicator control signals 186 control movement of the first and second label applicators 162*a*, 162*b* between the labeling devices 162*a*, 162*b* and the package 102. The applicator control signals 186 control movement of the first and second label applicators 162*a*, 162*b* to position the labels 106, 108 at particular sides 200 of the package 102, which may be based on the orientation of the package 102 in the labeling station 112 (for example, based on which side 200 has the identification tag 104). The applicator control signals 186 control movement of the first and second label applicators 162*a*, 162*b* to position the label verification scanning devices 170 relative to the package 102 in the labeling station 112.

In an exemplary embodiment, after label application, the robotic labeling system 100 performs label verification. Label verification is performed to reject some packages, such as if the labels are improperly applied. If the package 102 passes the label verification process, the package 102 may be moved along to another processing station or to shipping. The label verification scanning devices 170 are operated to scan the labels 106, 108 and verify that the labels 106, 108 have been applied properly, such as to verify that appropriate labels are applied and/or the labels are appropriately positioned and/or the labels are visible. The label verification scanning devices 170 transmit verification data 188 to the package labeling controller 50. The package labeling controller 50 receives the verification data 188 and communicates the verification information 82 to the verification module 80. The verification data 188 is used by the label verification module 80 to approve or reject the package 102.

Figure 4:
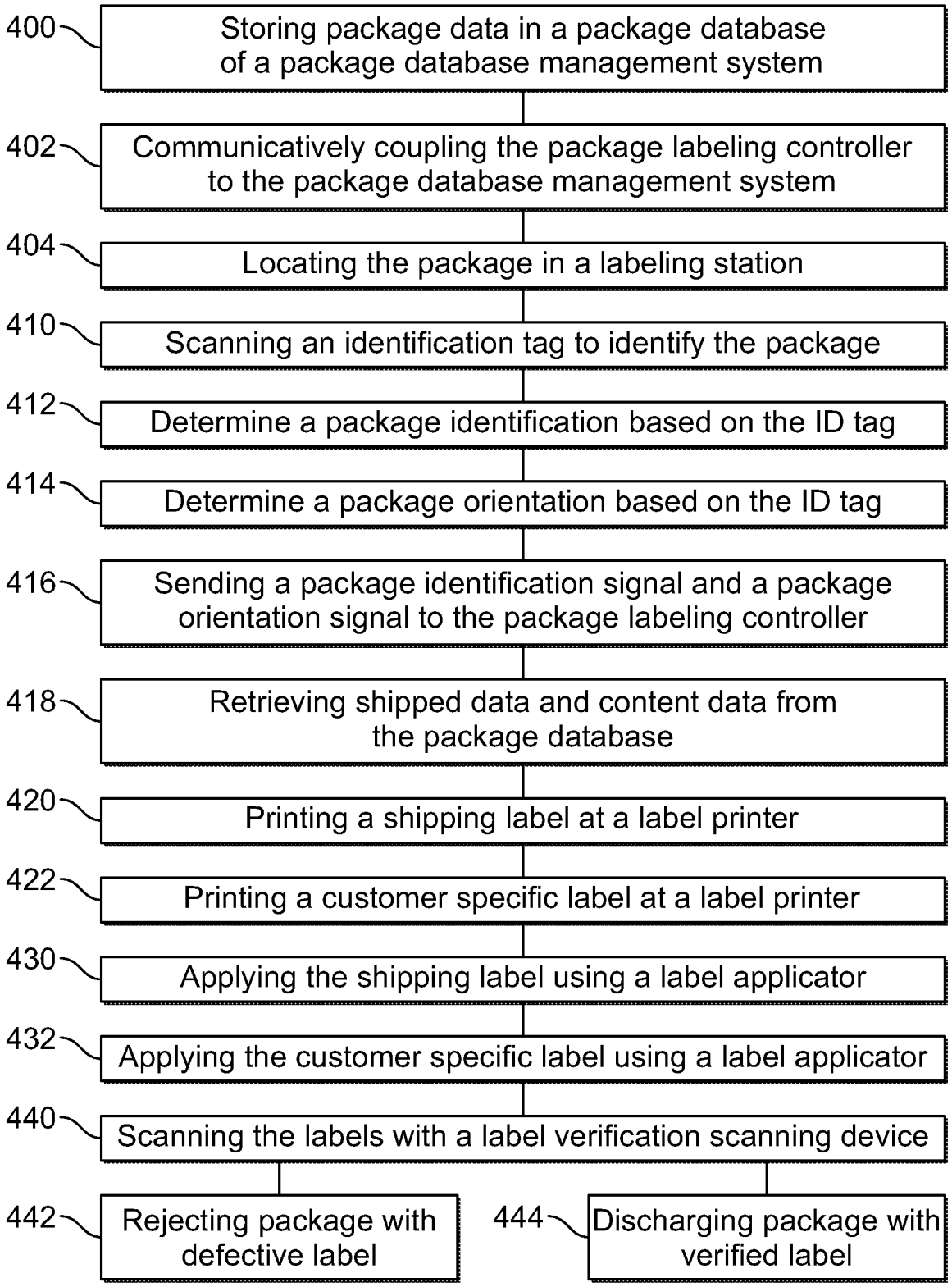
FIG. 4 is a flowchart of a method of labeling a package in accordance with an exemplary embodiment.

FIG. 4 is a flowchart of a method of labeling a package in accordance with an exemplary embodiment. Various steps may be omitted in the order of the steps may be altered in various alternative embodiments. The method includes storing 400 package data specific to the packages in the package database of the package database management system. The package data may include package identification data, content data, dimensional data, shipping data, label data, and the like. The package data may be contained in a package list in the package database. The package data stored in the package database is used by the robotic labeling system to control operations of components of the robotic labeling system.

The method includes communicatively coupling 402 the package labeling controller to the package database management system. The package labeling controller is coupled to the package database management system through a first communication bus. The package data may be transmitted to the package labeling controller, such as for controlling operation of components of the robotic labeling system. Data and/or signals may be transmitted from the package labeling controller to the package database management system, such as trigger signals to trigger label printing or label verification data to trigger the label verification process.

The method includes locating 404 the package in a labeling station. For example, the package may be transported to the labeling station by a conveyor or other transportation device. The package may be located by an indexing device, such as a stop gate a side rail or another positioning device. The package may be positioned by engaging one or more datum surfaces to locate the package in the labeling station. The package is fixed or indexed at a predetermined position in the labeling station for label application. For example, the label applicators are controlled to place the labels relative to a reference or datum location based on the package being located at the particular, predetermined position in the labeling station.

The method includes scanning 410 an identification tag on the package using a scanning device to identify the package. The identification tag may be scanned using one or more cameras. The method includes determining 412 a package identification of the package based on the identification tag scan. For example, the package identification may be determined from the package database using the identification tag scan. The method includes determining 414 an orientation of the package based on the scanning of the identification tag by the scanning device. For example, the scanning device may be used to determine which side includes the identification tag. The orientation may be used to determine to which side(s) the label(s) should be applied. The identification tag may be scanned to determine information about the package, such as the contents of the package, shipping information for the package, dimensions of the package, and the like. The method optionally includes the step of determining a height, a length and a width of the package based on the scanning of the identification tag by the scanning device. For example, the scanning device may be used to determine the height, the length and the width based on images of the package from the cameras. In other embodiments, the dimensions of the package may be determined using the package database based on the scanned identification tag.

The method includes sending 416 a package identification signal and the package orientation signal to the package labeling controller based on the scanned identification tag. The package identification signal and the package orientation signal may be transmitted from the package labeling controller to the package database management system through the first communication bus. The method includes retrieving 418 the shipping data and the content data specific to the package from the package database based on the package identification signal.

The method includes printing 420 a shipping label for the package at a labeling device based on the shipping data from the package database and printing 422 a customer specific label for the package based on the content data from the package database. For example, the labeling device(s) may be used to print the shipping label and the customer specific label. The customer specific label may include information relating to the contents of the package or other information. For example, the customer specified label may contain information about the shipper of the package, the location of where the package is being shipped from, return shipping information, warning labels regarding the package or the content of the package, and the like.

The method includes applying 430 the shipping label to the package and applying 432 the customer specific label to the package using the label applicator(s). The label applicators pick up the labels from the labeling devices. For example, the end effector picks up the corresponding label, such as using a suction plate. The label applicator transfers the label from the labeling device to the package. At the package, the label applicator may press the label onto the side of the package. Optionally, the operation of the label applicator may be controlled based on the package orientation signal. For example, the side of the package that receives the label may be based on the orientation of the package (for example, the side of the package having the identification label). Optionally, the operation of the label applicator may be controlled based on the determined height, length and width dimensions of the package. For example, the amount of movement in three dimensional space of the arm of the label applicator may be determined based on the size and shape of the package.

The method includes scanning 440 the labels applied to the package using label verification scanning devices to verify proper application of the labels. For example, the label verification scanning devices may verify that the labels have been properly applied and are located on the proper side(s) of the package and/or in the proper location(s) on the package. The label verification scanning devices may verify that the label has the appropriate information printed on the labels and that the information printed is legible and/or scannable. The label verification scanning devices may verify that the labels are applied correctly and without wrinkles. Label verification is performed to reject some packages, such as if the labels are improperly applied. If the package passes the label verification process, the package may be moved along to another processing station or to shipping. The label verification scanning devices may include a camera configured to image the labels. In various embodiments, the label verification scanning devices may be coupled to the label applicators and movable with the label applicators to scan the labels immediately after the labels are applied, such as prior to the label applicators moving away from the application area.

The method includes rejecting 442 the package if the label verification scanning device determines the applied label is defective. For example, the package may be removed from the labeling station and either discarded or moved to a station for reworking the package (for example, removing the defective label).

The method includes discharging 444 the package from the labeling station if the label verification scanning device verifies that the label is properly applied to the package 102. The package may be transferred downstream, such as by the conveyor, to the next processing station, such as a package sorting station.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A robotic labeling system for packages comprising:

a package database management system including a package database, the package database storing package identification data specific to each of the packages, the package database storing shipping data specific to each of the packages, and the package database storing content data specific to each of the packages;

a package labeling controller communicatively coupled to the package database management system;

a package locating system operably coupled to the package labeling controller to receive locating inputs from the package labeling controller for locating the packages at a labeling station;

a package identification system operably coupled to the package labeling controller, the package identification system having a scanning device configured to scan an identification tag on the package to determine a package identification of the package and to determine an orientation of the package in the labeling station from a plurality of possible orientations by determining which side of the package contains the identification tag, the package identification system sending a package identification signal to the package labeling controller based on the scan, the package identification system sending a package orientation signal to the package labeling controller based on the scan; and a label application system operably coupled to the package labeling controller, the label application system including at least one labeling device and at least one label applicator, the at least one labeling device preparing a shipping label for the package based on the shipping data stored in the package database, the at least one labeling device preparing a customer specific label for the package based on the content data stored in the package database, the at least one label applicator operated to apply the shipping label to a different side of the package than the side having the identification tag based on the package orientation signal, the at least one label applicator operated to apply the customer specific label to a different side of the package than the side having the identification tag based on the package orientation signal.

2. The robotic labeling system of claim 1, wherein the package labeling controller communicates with the package database management system through a first communication bus, and wherein the package labeling controller communicates with the package locating system, the package identification system, and the label application system through a second communication bus.

3. The robotic labeling system of claim 1, wherein the package database stores label orientation data specific to the package, the label application system controlling positioning of the at least one label applicator relative to the package in the labeling station based on the package orientation signal and the label orientation data.

4. The robotic labeling system of claim 1, wherein the label application system includes a label verification scanning device configured to scan the shipping label and the customer specific label applied to the package and generate verification scan signals communicated to the package labeling controller for verification of proper application thereof.

5. The robotic labeling system of claim 1, wherein the package identification system uses the scan of the identification tag by the scanning device to determine the orientation of the package.

6. The robotic labeling system of claim 1, wherein the package identification data includes dimension data for the specific package, the label application system being operated to apply the shipping label and the customer specific label to the package based on the dimension data.

7. The robotic labeling system of claim 1, wherein the package identification system includes a package measurement module to determine a height, a width, and a length of the package based on the scan, the label application system using the height, the width and the length dimensions to control the label applicator.

8. The robotic labeling system of claim 1, wherein the scanning device includes a plurality of cameras configured to scan multiple sides of the package.

9. The robotic labeling system of claim 1, wherein the at least one label applicator includes a multi-axis robot having an arm movable in three-dimensional space and an end effector coupled to the arm to move between the at least one labeling device to the package.

10. The robotic labeling system of claim 1, wherein the at least one labeling device includes a first labeling device and a second labeling device and wherein the at least one label applicator includes a first label applicator and a second label applicator, the first labeling device preparing the shipping label for the package and the first label applicator applies the shipping label to the package, the second labeling device preparing the customer specific label for the package and the second label applicator applies the customer specific label to the package.

11. The robotic labeling system of claim 10, wherein the first labeling device is a first label printer configured to print the shipping label, and wherein the second labeling device is a second label printer configured to print the customer specific label.

12. The robotic labeling system of claim 1, wherein the package database management system includes a label communication module communicatively coupled to the at least one labeling device, the label communication module sending shipping data and content data directly to the at least one labeling device.

13. The method of claim 12, wherein said preparing the shipping label and the customer specific label comprises printing the shipping label and the customer specific label.

14. A method of labeling packages comprising:

storing package identification data specific to each of the packages, shipping data specific to each of the packages, and content data specific to each of the packages in a package database of a package database management system;

communicatively coupling a package labeling controller to the package database management system;

locating the package in a labeling station;

scanning an identification tag on the package using a scanning device to determine a package identification of the package and to determine an orientation of the package in the labeling station from a plurality of possible orientations by determining which side of the package contains the identification tag;

sending a package identification signal and a package orientation signal to the package labeling controller based on the scan;

retrieving the shipping data and the content data specific to the package from the package database based on the package identification signal;

preparing a shipping label for the package based on the shipping data from the package database and a customer specific label for the package based on the content data from the package database;

applying the shipping label and the customer specific label to different sides of the package than the side having the identification tag based on the package orientation signal; and scanning the shipping label and the customer specific label applied to the package using a label verification scanning device to verify proper application of the shipping label and the customer specific label.

15. The method of claim 14, further comprising sending a label verification signal from the label verification scanning device to at least one of the package labeling controller and the package database management system to determine if the applied label is defective and rejecting the package if the label verification scanning device determines the applied label is defective.

16. The method of claim 14, wherein said applying the label using the label applicator comprises controlling operation of the label application based on the orientation of the package.

17. The method of claim 14, further comprising determining a height, a length and a width of the package, said applying the label using the label applicator comprises controlling operation of the label application based on the determined height, length and width dimensions of the package.

18. The method of claim 17, wherein the package identification data stored in the package database includes height data, length data and width data of the package, said determining the height, the length and the width of the package comprises sending the height data, the length data and the width data from the package database management system to the package labeling controller.

19. The method of claim 14, further comprising storing label orientation data specific to the package at the package database, said applying the shipping label comprises controlling positioning of a label applicator relative to the package based on the orientation of the package in the labeling station and the label orientation data.

20. The method of claim 14, wherein said applying the shipping label comprises controlling positioning of a label applicator relative to the package based on the side determined to have the identification tag to apply the label to a different side of the package than the side having the identification tag.

* * * * *